US009254580B2

(12) United States Patent
Frolov

(10) Patent No.: US 9,254,580 B2
(45) Date of Patent: Feb. 9, 2016

(54) GUARD SYSTEM FOR A POWER SAW

(75) Inventor: Andrew Frolov, Glenview, IL (US)

(73) Assignee: Robert Bosch GmbH, Stuttgart (DE)

( * ) Notice: Subject to any disclaimer, the term of this patent is extended or adjusted under 35 U.S.C. 154(b) by 1300 days.

(21) Appl. No.: 12/559,873

(22) Filed: Sep. 15, 2009

(65) Prior Publication Data

US 2011/0061506 A1 Mar. 17, 2011

(51) Int. Cl.
*B27G 19/02* (2006.01)
*B27G 19/08* (2006.01)

(52) U.S. Cl.
CPC ..... *B27G 19/08* (2013.01); *B27G 19/02* (2013.01); *Y10T 83/2077* (2015.04); *Y10T 83/732* (2015.04); *Y10T 83/773* (2015.04); *Y10T 83/7734* (2015.04)

(58) Field of Classification Search
CPC .... B27G 19/02; B27G 19/08; Y10T 83/2077; Y10T 83/732; Y10T 83/773; Y10T 83/7734
USPC ..... 83/102.1, 478, 860, DIG. 1, 397, 440.2, 83/446–448, 450, 477.2, 544–546; 292/11, 13, 50, 250, 256.6, 256.63, 292/256.69, 256.75, DIG. 49
IPC ..... B27G 19/02, 19/08; Y10T 83/2077, Y10T 83/732, 83/773, 83/7734
See application file for complete search history.

(56) References Cited

U.S. PATENT DOCUMENTS 281,275 A * 7/1883 Kuhlmann ..... 83/102.1
545,504 A * 9/1895 Hoover ..... 83/102.1
1,244,187 A * 10/1917 Frisbie ..... 83/860
1,451,356 A * 4/1923 Yemniker ..... 292/250
1,478,500 A * 12/1923 Willringhaus ..... 292/250
1,512,142 A * 10/1924 Sessions ..... 292/247
2,007,887 A * 7/1935 Tautz ..... 83/102.1
2,655,397 A * 10/1953 Augspurger et al. .... 292/256.69
7,210,386 B1 5/2007 Chang
7,302,878 B2 12/2007 Chang
7,568,739 B2 * 8/2009 Lee ..... 292/80
7,814,818 B2 * 10/2010 Domeny et al. ..... 83/102.1
2006/0042441 A1 3/2006 Ichikawa et al.
2007/0113714 A1 * 5/2007 Burke et al. ..... 83/102.1
2007/0163408 A1 * 7/2007 Buck et al. ..... 83/438
2007/0186739 A1 * 8/2007 Peot et al. ..... 83/102.1

FOREIGN PATENT DOCUMENTS

EP 0 852 278 * 7/1998

* cited by examiner

*Primary Examiner* — Clark F Dexter
(74) *Attorney, Agent, or Firm* — Maginot Moore & Beck LLP

(57) ABSTRACT

A modular guard system for a power saw includes a riving knife mounted to the saw rearwardly of the blade and having first and second notches with openings facing away from each other. A blade guard assembly is releasably mounted on the riving knife and configured to cover the blade. The blade guard assembly includes a mounting portion configured to receive a top portion of the riving knife having the first and second notches and a release mechanism provided in the mounting portion and having a spring member for engaging the first notch and a latch member connected to the spring member for engaging the second notch. The latch member exerts a force on the spring member to cooperatively hold the first and second notches between the spring member and the latch member to retain the riving knife in the mounting portion.

8 Claims, 10 Drawing Sheets

GUARD SYSTEM FOR A POWER SAW

BACKGROUND OF THE INVENTION

The present invention generally relates to power tools and, more particularly, to power table saws.

Guard systems for power table saws typically include three components, namely, a splitter or riving knife, a kickback prevention device, and a blade guard that covers the blade. A kickback prevention device is a safety device that reduces the likelihood of a kick-back event where a work piece is somehow caught or bound up during a cutting operation and the inertia of the blade throws the work piece back toward the user. A riving knife is typically considered to function similarly to a spreader or splitter on a blade guard assembly, but does not extend above the top of the blade.

Depending on the type of cut being made, there are times when it is desirable to separate and remove the blade guard from the riving knife. For example, when making a non-through cut, the user must remove the guard system if the guard system is of the type which is attached to the undercarriage or the rear of the table saw. These mounting configurations are typically utilized on most portable and bench top models that are presently commercialized. Because there is a need to remove the guard system during non-through and other special types of cuts and because special wrenches or the like are often necessary to do so on many commercial bench top models, many users simply leave the guard system off. While some table saws incorporate features in the blade guard for removing the blade guard without the use of tools, they utilize internal mounting with very limited spring action, which requires very high precision of all mating parts.

SUMMARY OF THE INVENTION

A preferred embodiment of the present invention is directed to a modular guard system for a power saw of the type which has a table top, a rotatable circular saw blade, and an opening on the table top through which the saw blade extends. The system includes a riving knife mounted to the saw rearwardly of the blade. The riving knife has forward and rear notches that have openings facing away from each other. A blade guard assembly is releasably mounted on the riving knife and configured to cover the blade.

The blade guard assembly includes a mounting portion configured to receive a top portion of the riving knife having the forward and rear notches. A release mechanism is provided in the mounting portion and has a spring member for engaging the forward notch and a latch member connected to the spring member for engaging the rear notch. The latch member exerts a force on the spring member to cooperatively hold the forward and rear notches between the spring member and the latch member to retain the riving knife in the mounting portion. The riving knife is released from the mounting portion when the force exerted on the spring member is removed by the latch member and the spring member is disengaged from the forward notch.

DETAILED DESCRIPTION

The preferred embodiment of the present invention comprises a modular saw guard system that has a blade guard assembly which can be quickly attached to and/or removed from a riving knife using a quick release mechanism. The release mechanism includes a spring clip and a latch that cooperatively hook on to a pair of notches on the riving knife to firmly mount the blade guard assembly to the riving knife. With the modular configuration of the embodiments of the present system, the end user is more likely to use the blade guard for a particular task being carried out on the table saw. Moreover, the spring action in the quick release mechanism of the present invention eliminates the need for high precision mating of operational parts, which typically has a high fabrication cost associated with it. As a result, the manufacturing cost of the quick release mechanism and, accordingly, the blade guard assembly, is significantly reduced.

While the illustrated embodiments of the present invention are shown in connection with a power table saw, it should be understood that the system mechanisms can be utilized in other tools and environments, and that such other applications should be considered to be within the spirit and scope of the present invention. For example, embodiments of the present invention may be used with saws that are known as combo saws and flip saws that are marketed in Europe and possibly elsewhere.

Figure 1:
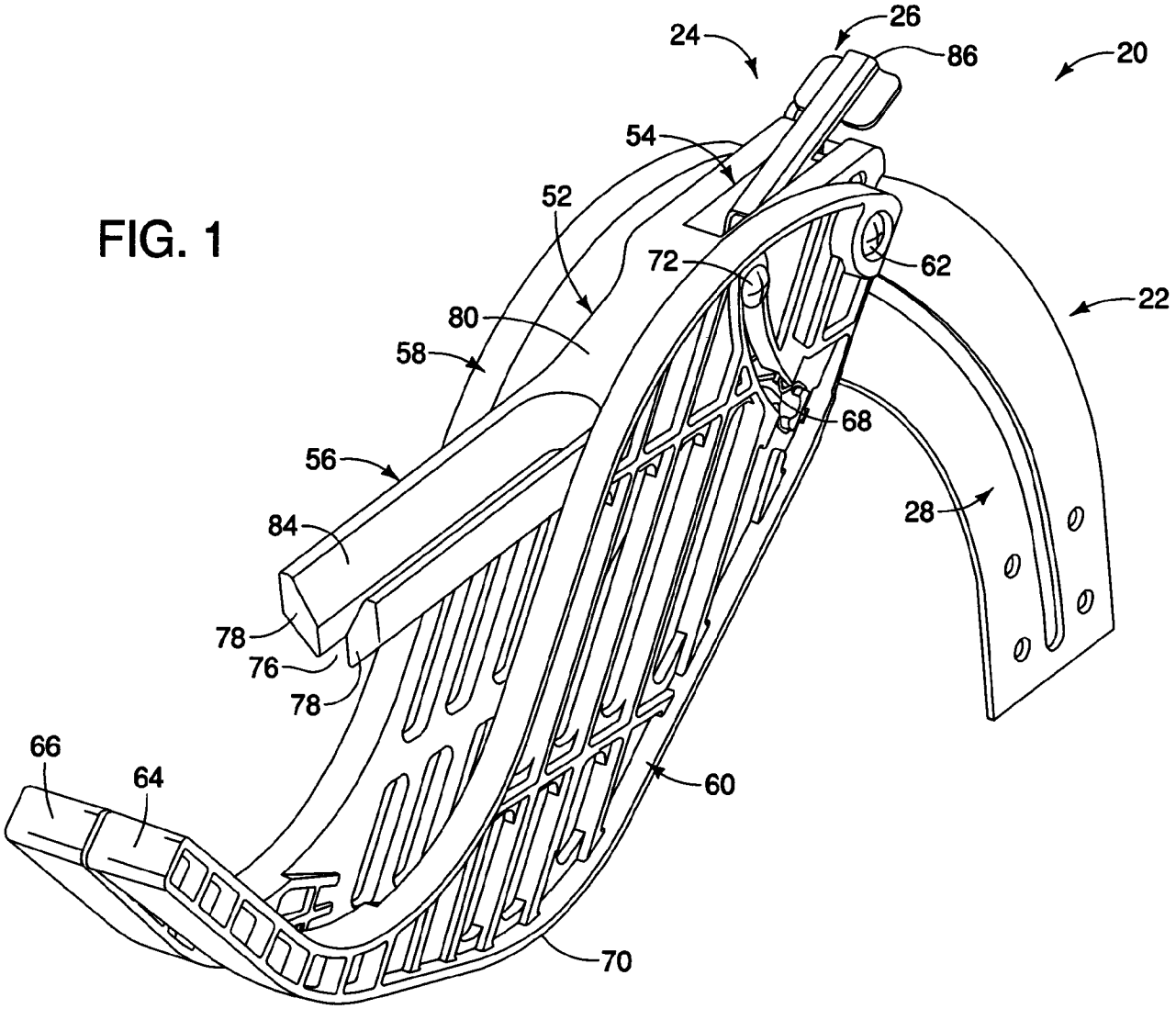
FIG. 1 is a perspective view of the front right side of the preferred embodiment of a modular saw guard system of the present invention.

Turning now to the drawings and particularly FIG. 1, there is shown a modular saw guard system, indicated generally at 20, that includes a riving knife, indicated generally at 22 and a blade guard assembly, indicated generally at 24. The blade guard assembly 24 is configured to be mounted to the riving knife 22 and can be separated from the riving knife quickly and easily by virtue of a quick release mechanism indicated generally at 26.

The riving knife 22 is adjustable so that its elevation relative to the blade can be adjusted. More particularly, it can be positioned to any one of three elevations, including a retracted position where the top of the riving knife 22 is completely below the surface of the tabletop, a fully extended position and an intermediate position. In the fully extended and the intermediate positions, the top of the riving knife 22 extends above the elevation of the top of the blade. The riving knife 22 is mounted to a motor and arbor gear box assembly (not shown but well known to those skilled in the art) that drives the blade and is vertically as well as angularly adjustable.

Figure 2:
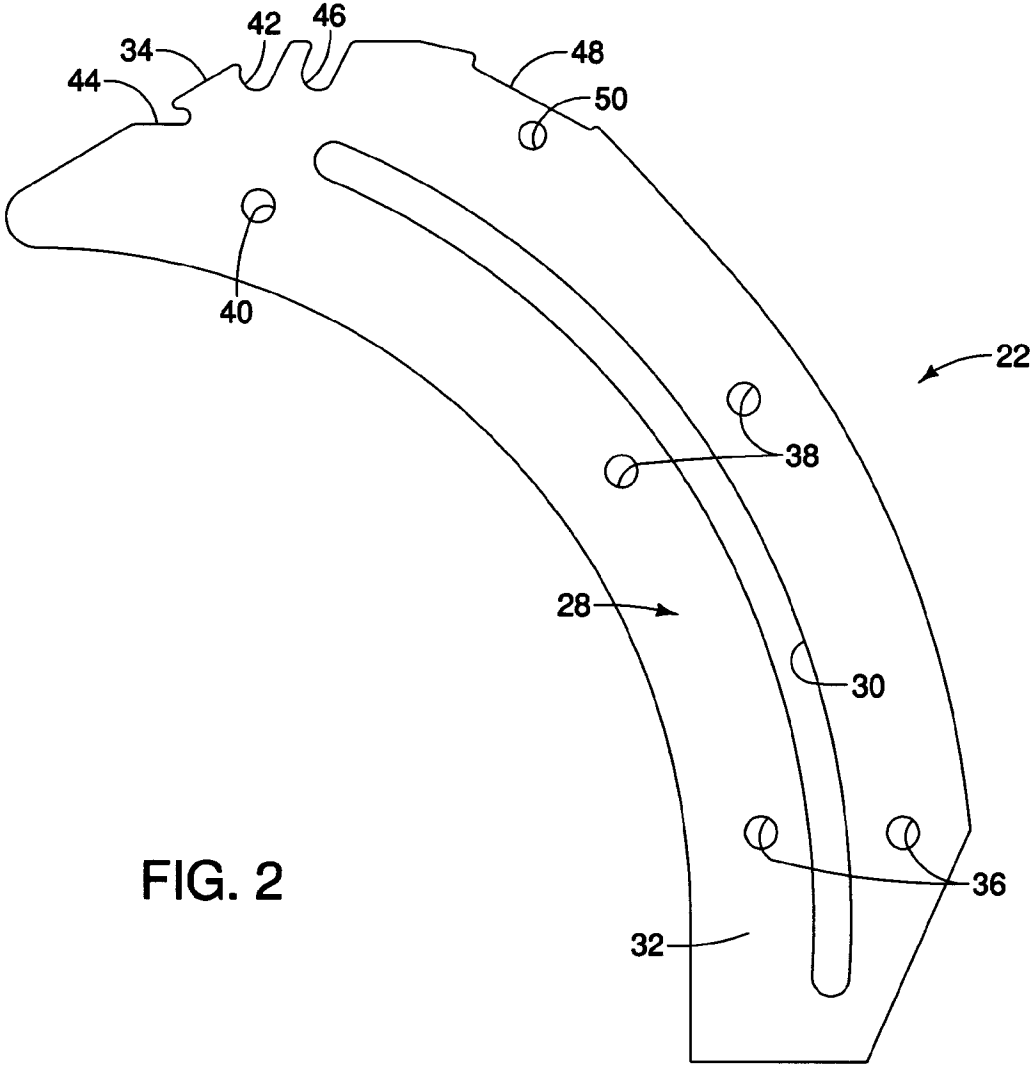
FIG. 2 is a plan view of a riving knife of the saw guard system.

The riving knife 22 is preferably a steel stamping and has an elongated generally curved thin body portion 28 as shown in FIG. 2, with a center slot 30 that extends from a bottom portion 32 to a top portion 34 of its height. A pair of apertures 36 are located on opposite sides of the slot 30 in the bottom portion 32, and a pair of apertures 38 are located on the opposite sides of the slot 30 proximate the midway between the top and bottom portions 34, 32. The apertures 36, 38 enable the riving knife 22 to be attached to the mounting post of the saw at its fully extended and intermediate positions. An aperture 40 along with an opening 42 positioned near the top portion 34 of the riving knife 22 enables the riving knife 22 to be attached to the mounting post of the saw at its lowest position.

When the riving knife mechanism is in its fully extended or highest position, the blade guard assembly 24 can be easily mounted to the riving knife 22. Alternatively, if better visualization is necessary, it is possible to remove the blade guard assembly 24.

The riving knife 22 further includes a pair of spaced forward and rear notches 44, 46. The forward notch 44 opens forward at the top portion 34 of the riving knife 22, and rear notch 46 rearward of the top portion, so that they open generally in the opposite directions. The forward and rear notches 44, 46 cooperate with a blade guard assembly quick release mechanism 26 (best shown in FIG. 1) to mount the blade guard assembly 24 to the riving knife 22. Also, the outside surface adjacent the rear notch 46 contains a flat surface 48 that cooperates with an aperture 50 for mounting a kickback prevention mechanism (not shown) to the riving knife 22.

Referring back to FIG. 1, the blade guard assembly 24 includes an upper guard barrier, indicated generally at 52, which includes a mounting portion 54 at one end that includes the quick release mechanism 26, and a blade receiving portion 56 at the opposite end. The blade guard assembly 24 also includes a pair of side guard barriers 58, 60 which are attached to the mounting portion 54 by large headed screws 62. The screws 62 are screwed into apertures 64 (best shown in FIG. 3) located on each side of the mounting portion 54. The side guard barriers 58, 60 thereby pivot around the attachment screws 62 which enables the side guard barriers to be lifted up when a work piece is pushed into position to be cut by a saw blade that is located between the side guard barriers 58, 60. The front end portions 64, 66 are upwardly flared or angled so that when a work piece is advanced to be cut, the work piece will contact the underside of the front end portions and lift the side guard barriers 58, 60 when they engage a work piece.

The side guard barriers 58, 60 each have an arcuate slot 68 that is provided to limit the rotational movement of the side guard barriers from the downward or lowermost position where a bottom surface 70 of the side guard barriers engages the top surface of a table saw. A second screw 72 is provided for each side guard barrier 58, 60 with the screws engaging apertures 74 (best shown in FIG. 3) on each side of the mounting portion 54. The second screws 72 also have an enlarged head that contacts the outer surface of the side guard barriers 58, 60 adjacent the slot 68, and a smooth cylindrical shank portion with a diameter slightly less than the width of the slot so as to permit pivoting of the barriers around the pivot screw 62 without interference. The side guard barriers 58, 60 are preferably made from a plastic or plastic-like material such as clear polycarbonate.

Figure 3:
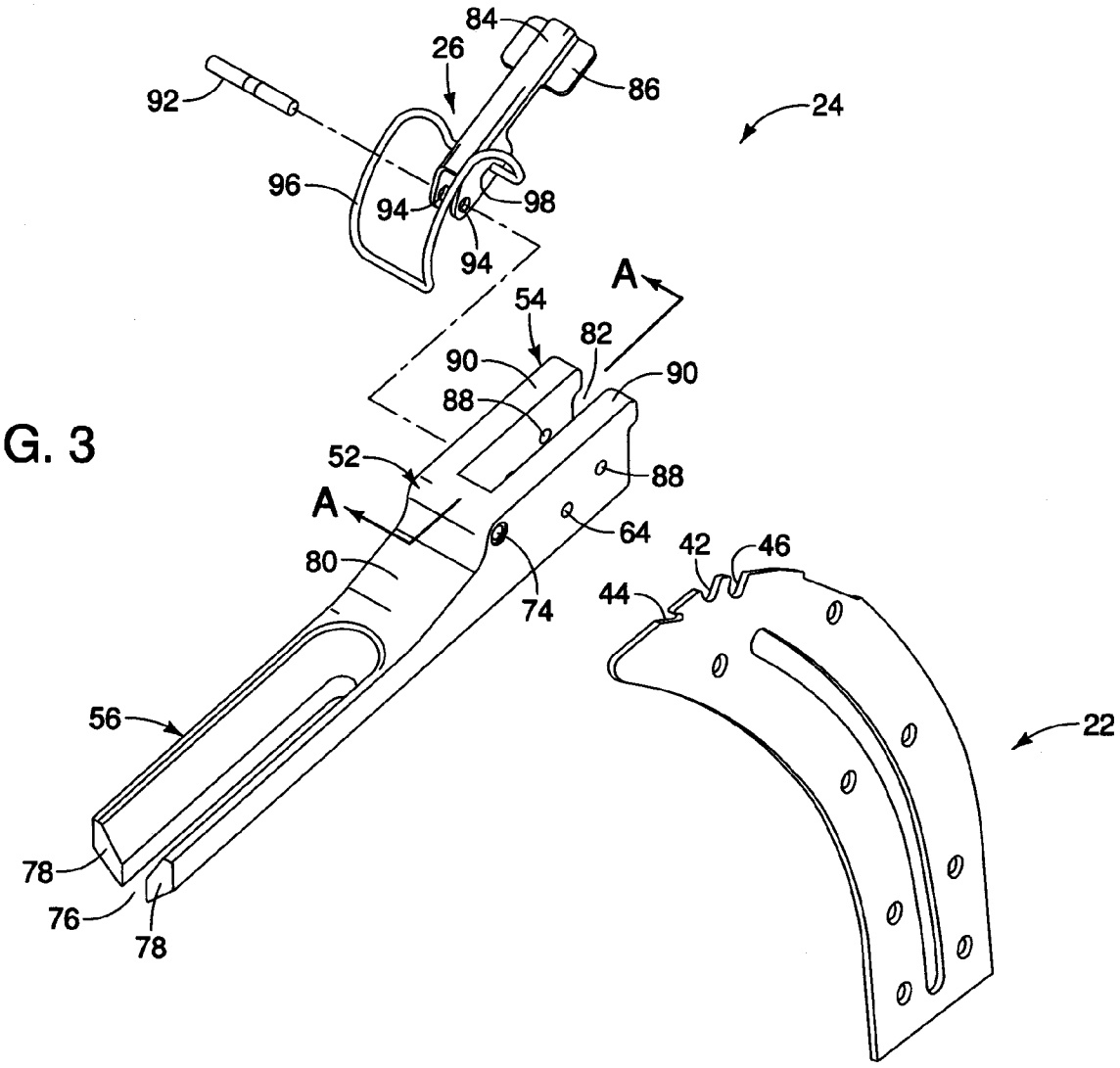
FIG. 3 is an exploded perspective view of a portion of the saw guard system shown in FIG. 1, with parts omitted for clarity.
Figure 4:
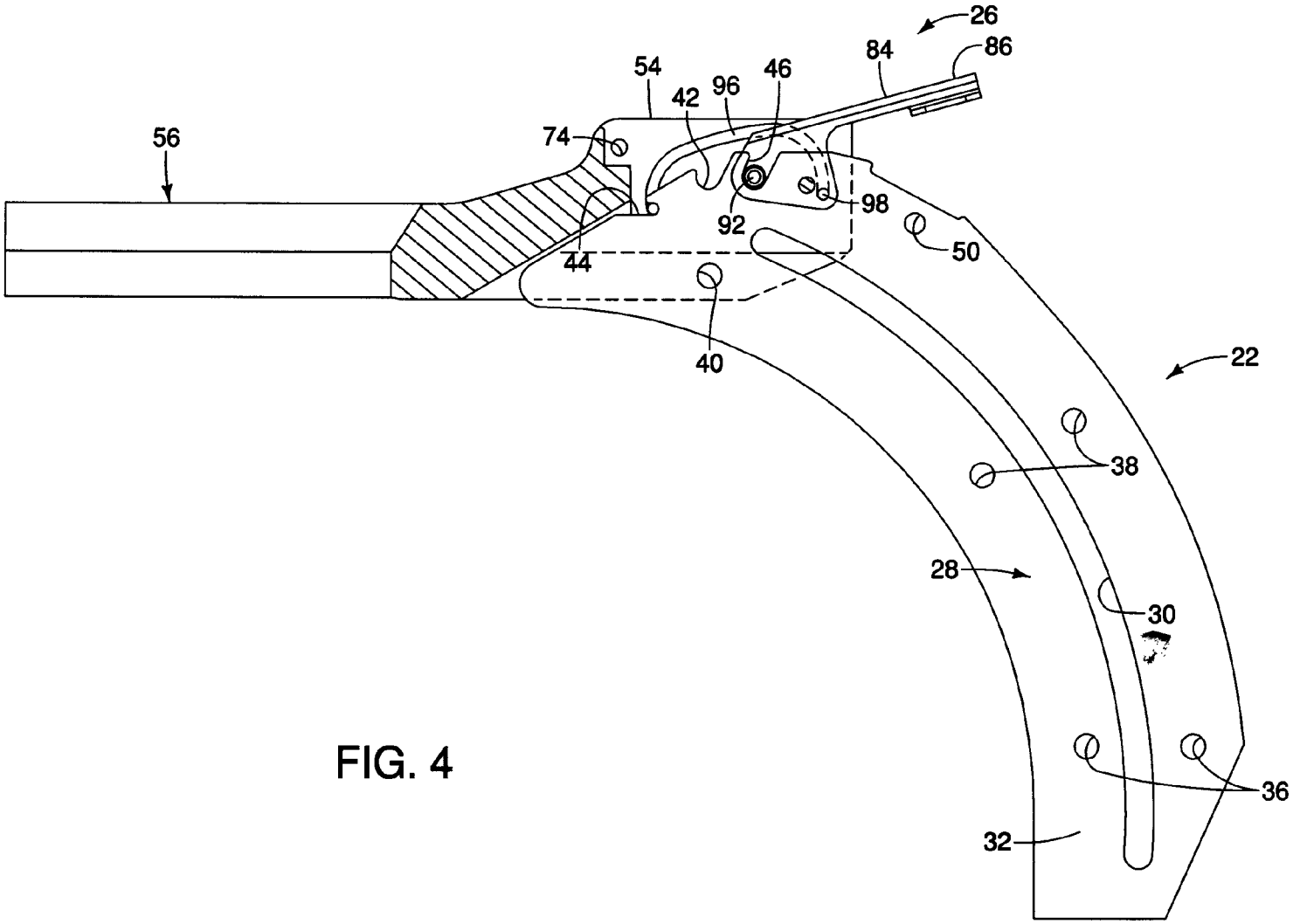
FIG. 4 is a sectional view of the blade guard assembly shown in FIG. 3 generally along line A-A, with a quick release mechanism in a locked position.
Figure 5:
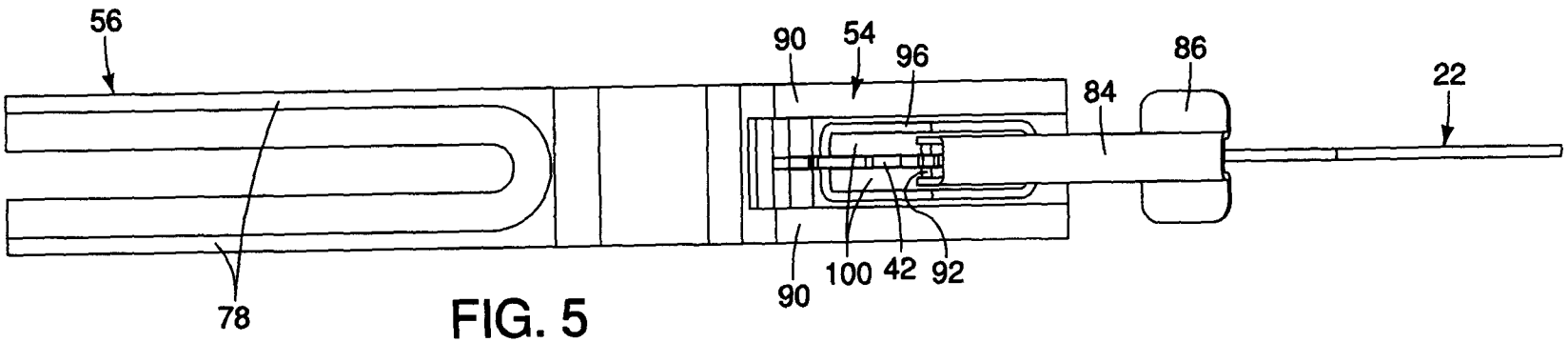
FIG. 5 is a top view of the blade guard assembly shown with the quick release mechanism in a locked position.

Turning to FIG. 3, the blade guard assembly 24 includes the blade receiving portion 56 for accepting the saw blade in an elongated channel 76 formed by a pair of legs 78 extending from a body portion 80 of the upper guard barrier 52. The legs 78 are angled away from the channel 76 to enable the operator to have a clear view of the blade. The upper guard barrier 52 is a rigid unitary piece preferably made of metal, but can also be made of other materials such as plastic.

The mounting portion 54 includes a center channel 82 in which the quick release mechanism 26 is located. The quick release mechanism 26 includes a latch 84 having a handle 86. It is pivotally connected to the mounting portion 54 at a pair of apertures 88 provided in spaced brackets 90 that form the center channel 82. The latch 84 is connected to the brackets 90 by virtue of a pin 92 which extends through apertures 94 at the end of the latch 84 and into the apertures 88 of the brackets.

The quick release mechanism 26 further includes a spring clip 96 which is pivotally connected to the latch 84 at a pair of apertures 98 provided generally about the middle portion of the latch, between the apertures 94 for receiving the pin 92 and the handle 86. In one embodiment, the spring clip 96 is formed from a metal wire which is sufficiently rigid and has the tensile strength to maintain its shape when force is exerted on it by the latch 84. The spring clip 96 may have two ends, each of which are inserted into the aperture 98 of the latch 84 and bent to prevent the ends from being pulled out. The two ends of the spring clip may also be welded, or otherwise connected together to prevent the ends from coming out of the aperture 98. While the spring clip 96 opposite the two ends is shown to be generally curved, it can also be formed in a V-shaped tip for better centering of the quick release mechanism 26 on the forward notch 44 of the riving knife 22.

Referring to FIGS. 3-6 and in operation, the latch 84 locks and unlocks the blade guard assembly 24 onto and from the top portion 34 of the riving knife 22. To effectuate the locking operation, the curved portion of the spring clip 96 is hooked onto the forward notch 44 and the pin 92 is inserted into the rear notch 46. When the handle 86 of the latch 84 is depressed to be placed into a generally horizontal position, the pin 92 acts as an axle on which the latch 84 pivots and creates a tension on the spring clip 96. In this manner, the forward and rear notches 44, 46 of the riving knife 22 are held tightly between the spring clip 96 and the axle pin 92 of the latch 84. As a result, the quick release mechanism 26 is firmly locked onto the riving knife 22 and accordingly, the blade guard assembly 24 (best shown in FIGS. 4 and 5).

To assist in firmly locking the blade guard assembly 24 onto the riving knife 22, the mounting portion 54 includes a pad 100 extending inwardly in the center channel 82 from each of the brackets 90 to snugly receive the riving knife 22 in a slot 102 formed within the center channel. The pads 100 can be made of steel or plastic, and may be welded, riveted or screwed to each of the brackets 90. It is contemplated that the pads 100 be spring-loaded or have bosses to compensate for dimensional variety of parts in assembly and holding the riving knife 22 between them.

Figure 6:
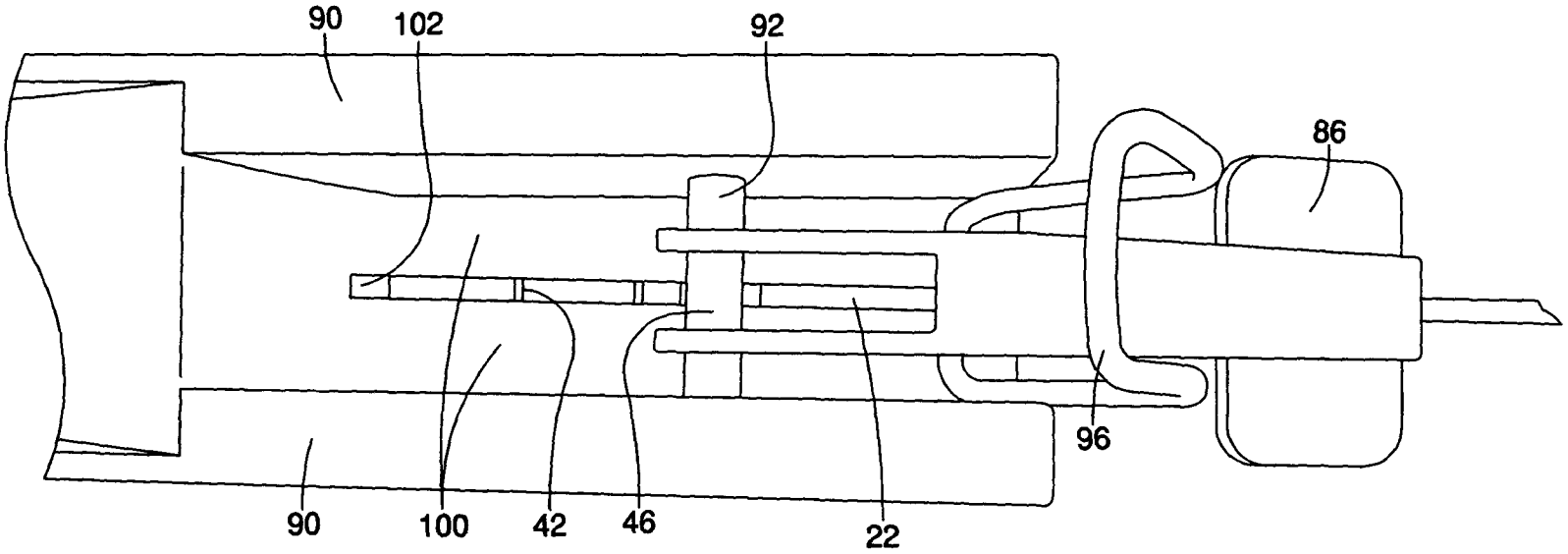
FIG. 6 is another top view of the mounting portion shown with the quick release mechanism in an unlocked position.

To disengage or detach the blade guard assembly 24 from the riving knife 22, the latch 84 is pushed upwardly in a direction away from the riving knife 22, so as to release the tension on the spring clip 96. This allows the spring clip 96 to be disengaged from the forward notch 44, as shown in FIG. 6, and enables the riving knife 22 to be slipped off the axle pin 92 and completely out of the slot 102 and the center channel 82.

Figure 7:
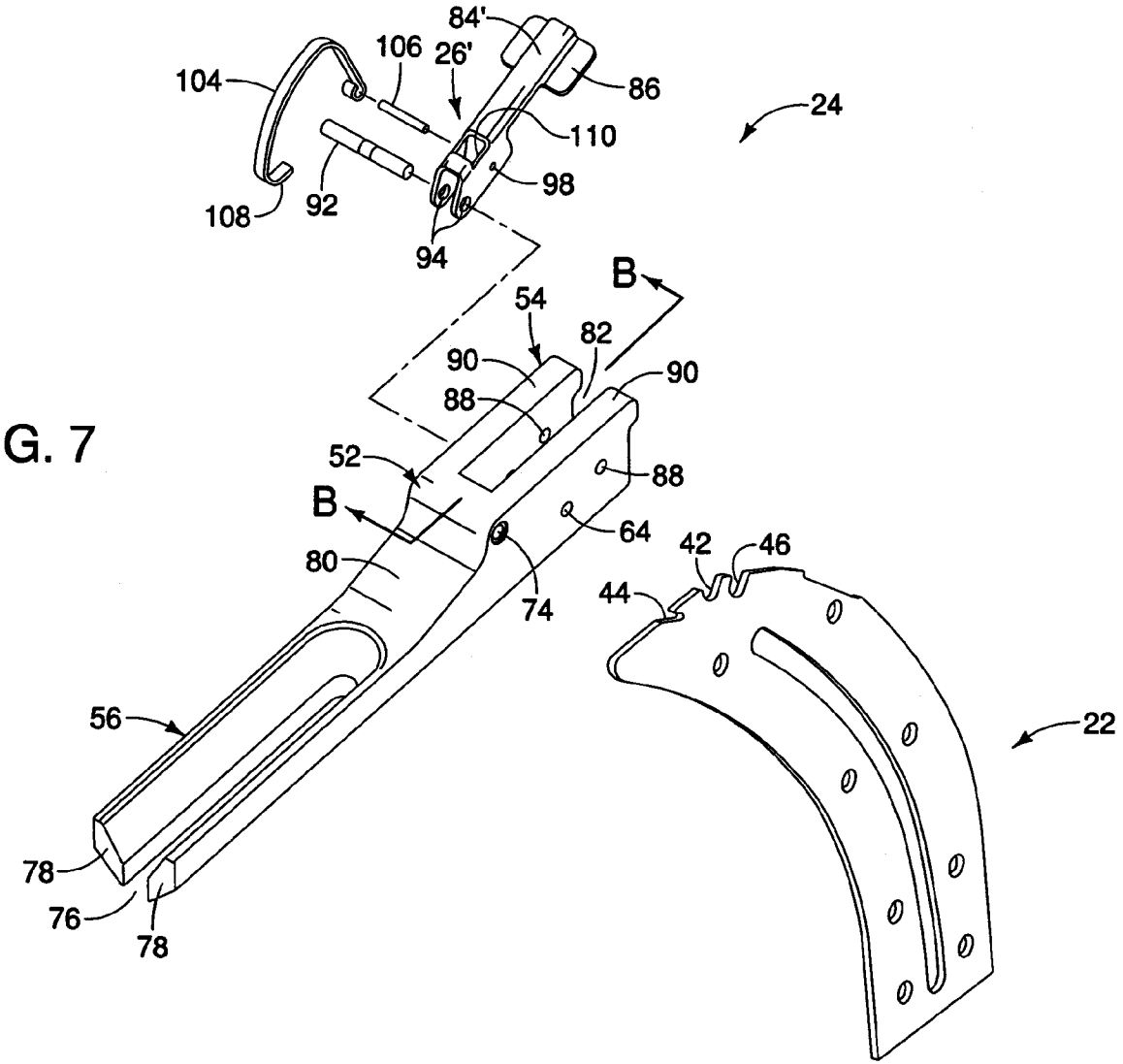
FIG. 7 is a perspective view of a first alternate embodiment of the blade guard assembly, shown without side guard barriers.

Turning now to FIG. 7, an alternate embodiment of the quick release mechanism 26 is shown, which illustrates components as having the same reference numbers and a prime designation. Thus, the above description with regard to the quick release mechanism 26 has applicability in the alternate embodiment. The alternate quick release mechanism 26' includes a flat spring 104 which is pivotally connected to a pin 106 at its rear end and has a hook portion 108 configured to releasably hook onto the forward notch 44 of the riving knife 22. The pin 106 is configured to be received in the apertures 98 provided between the handle 86 and the axle pin 92 in the apertures 94 at the opposite end of the latch 84'. To accommodate the flat spring 104, the latch 84' includes an opening 110 which allows the flat spring 104 to be connected to the pin 106, which acts as a hinge for the flat spring 110.

Figure 8:
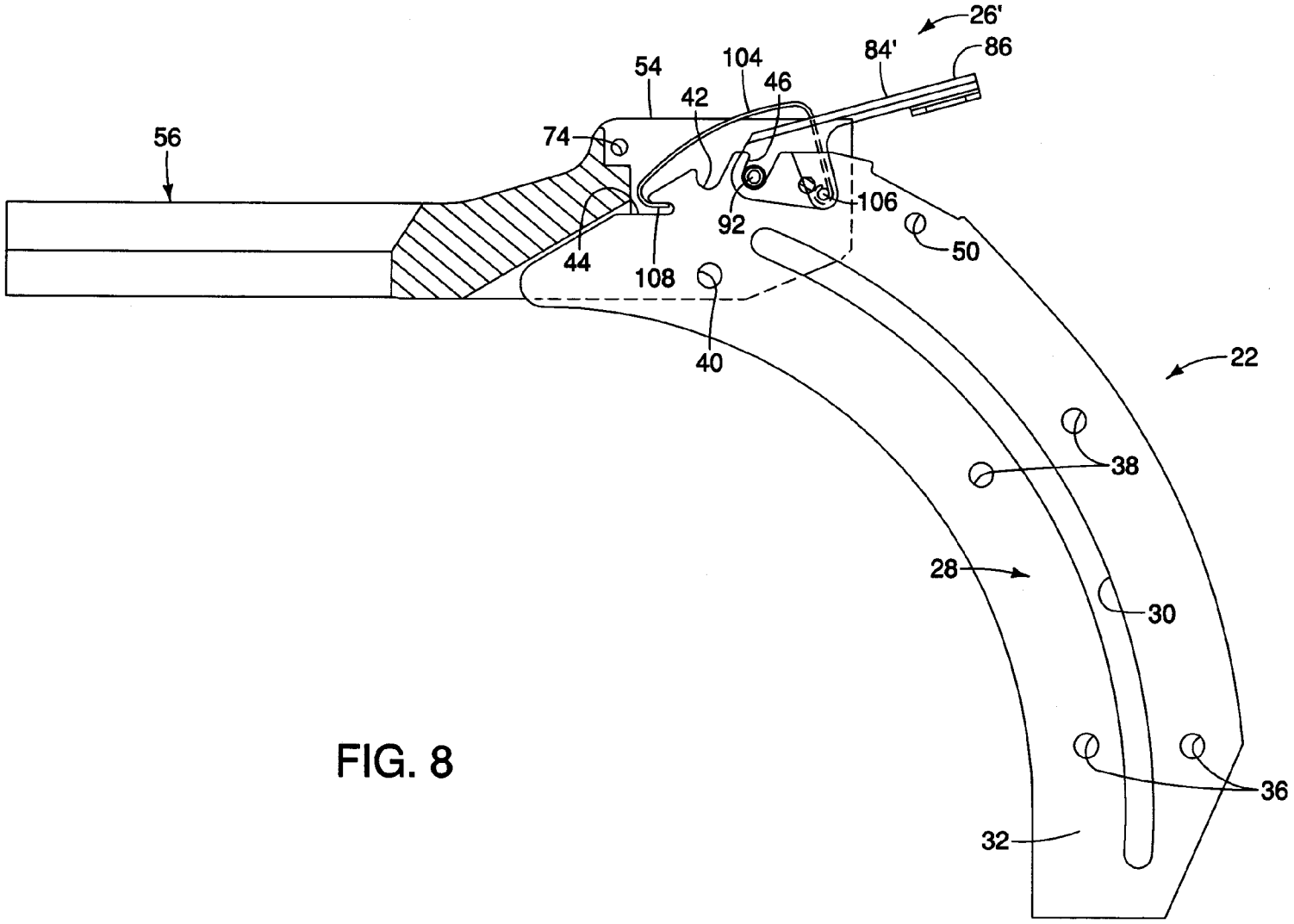
FIG. 8 is a sectional view of the blade guard assembly shown in FIG. 7 generally along line B-B, with a quick release mechanism in a locked position.
Figure 9:
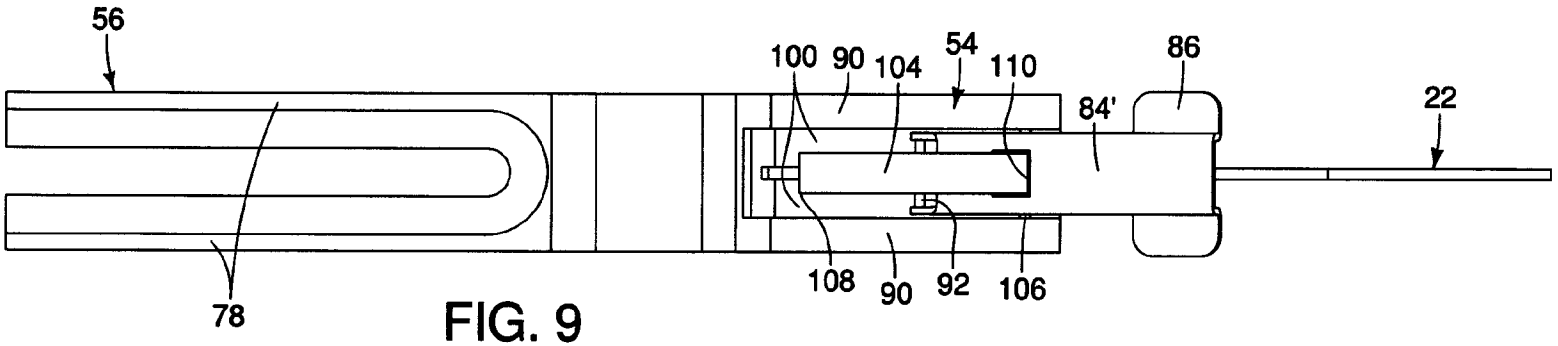
FIG. 9 is a top view of the blade guard assembly shown in FIG. 7, with the quick release mechanism in a locked position.

In operation, the latch 84' is placed in an up position where the handle 86 is lifted away from the mounting portion 54, and the hook 108 on the flat spring 104 is allowed to engage the forward notch 44. The handle 86 of the latch 84' is pushed down so that it is generally at a horizontal position with respect to the upper guard assembly 52 to lock the blade guard assembly 24 onto the riving knife 22. The quick release mechanism 26' in a locked position is shown in FIGS. 8 and 9. As in the embodiment described above, the latch 84' pivots about the axle pin 92.

To release the blade guard assembly 24 from the riving knife 22, the handle 86 is pushed in an upwardly direction, away from the riving knife 22 to release tension on the flat spring 104. The hook 108 is then disengaged from the forward notch 44 and the pin 106 from the rear notch 46.

Figure 10:
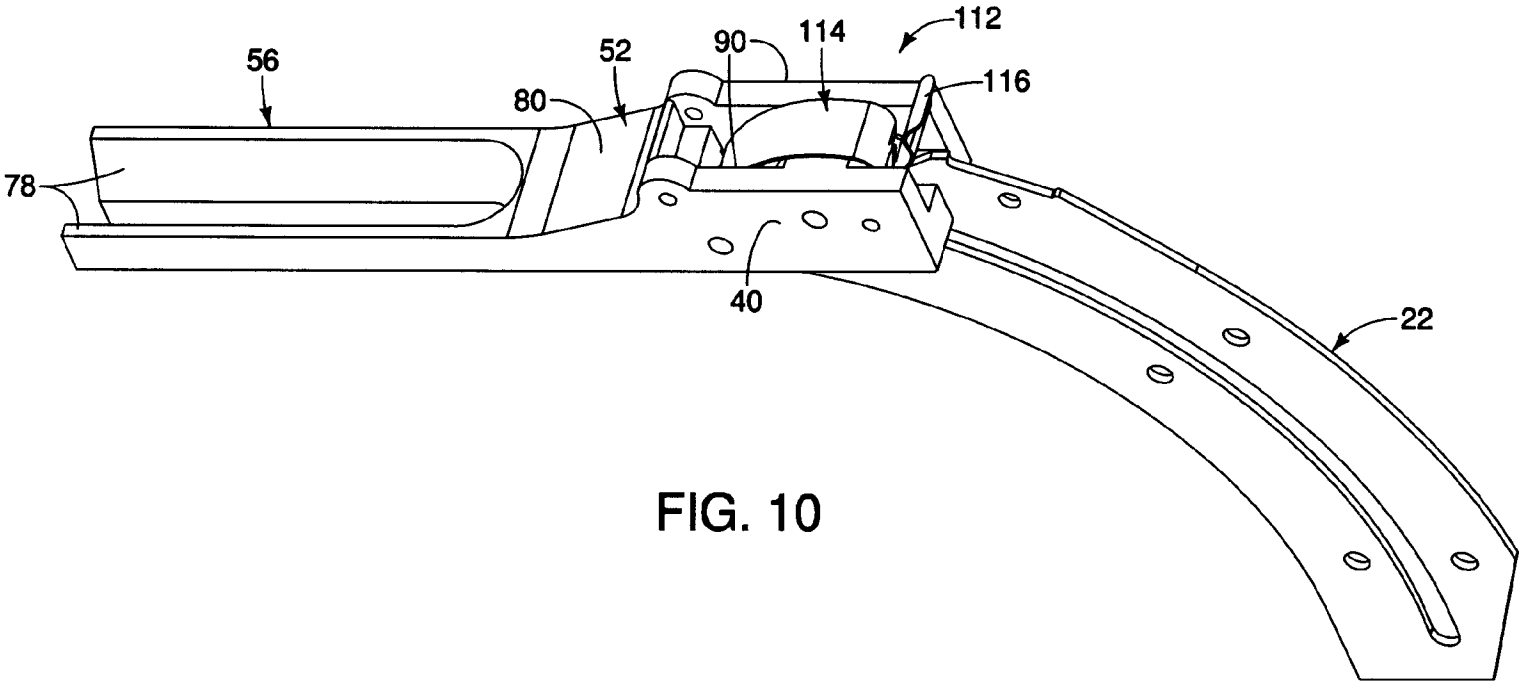
FIG. 10 is a perspective view of a second alternate embodiment of the blade guard assembly, shown without side guard barriers.
Figure 11:
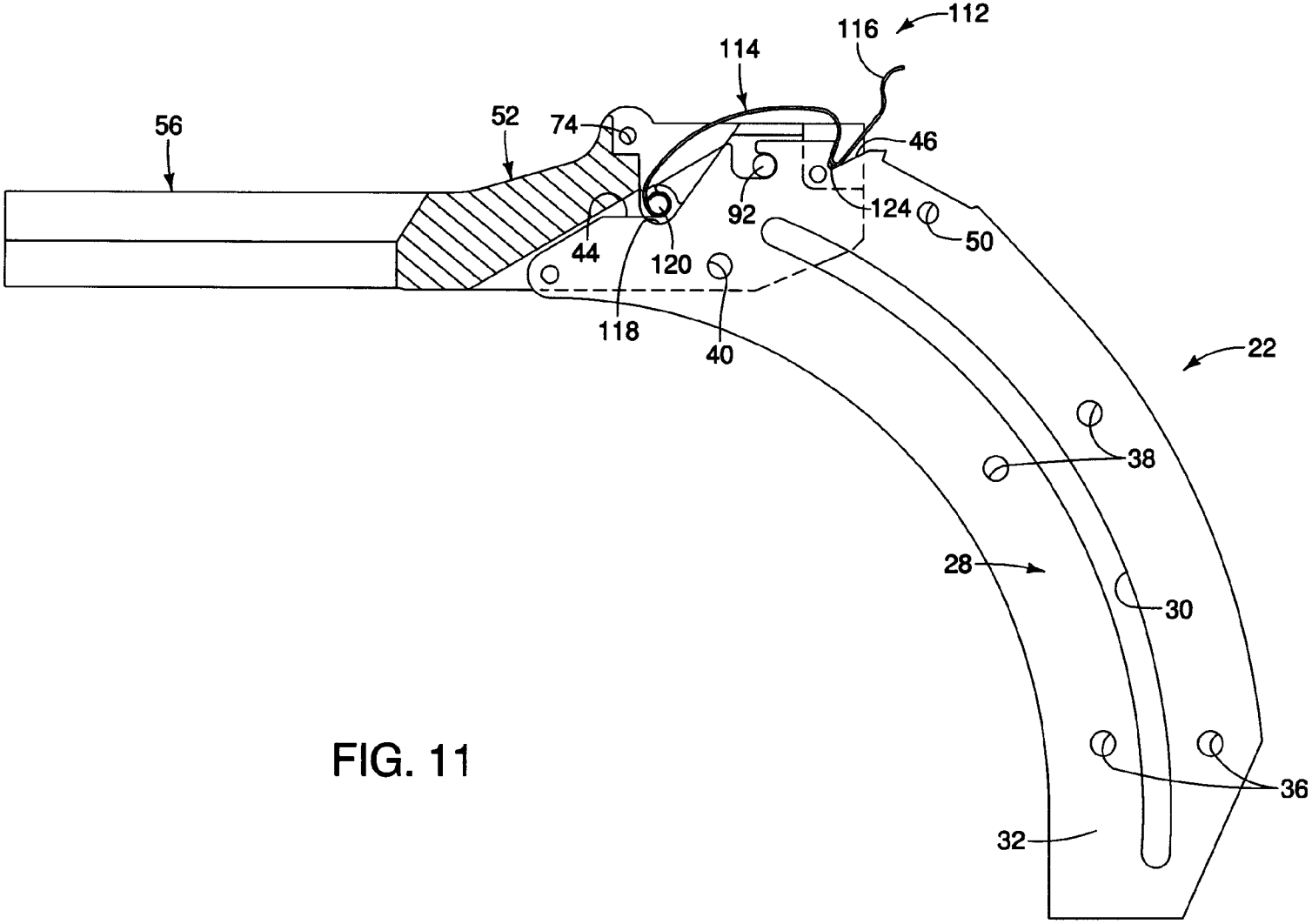
FIG. 11 is a sectional view of a mounting portion of the blade guard assembly shown in FIG. 10 generally along line C-C, with a quick release mechanism in a locked position.
Figure 12:
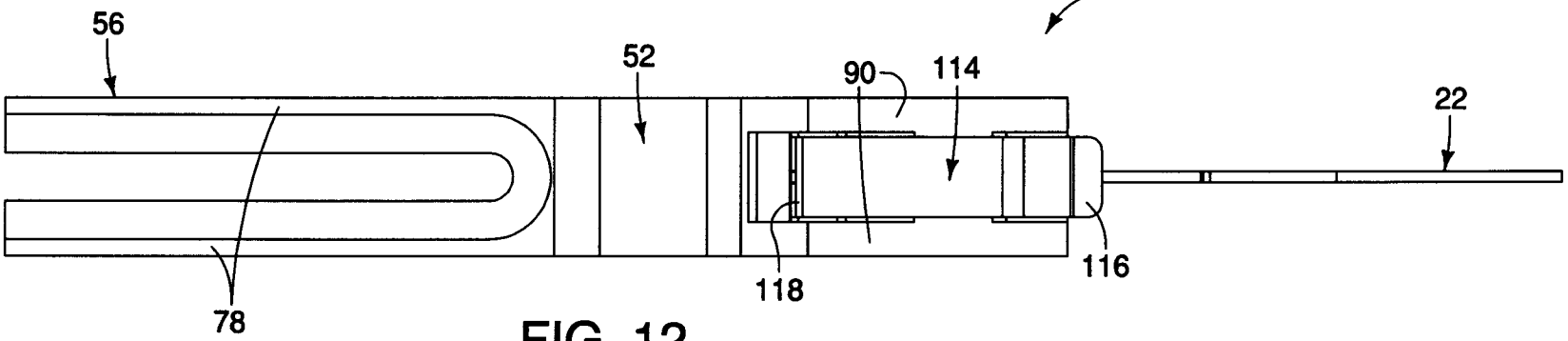
FIG. 12 is a top view of the mounting portion of FIG. 11, with the quick release mechanism in a locked position.

Referring now to FIGS. 10-12, another embodiment of a quick release assembly is shown. In the quick release assembly 112, a single integrated flat spring 114 acts both as a latch and a spring clip. The flat spring 114 of the quick release assembly 112 includes a handle portion 116 at one end and a connection portion 118 at the other end, which connection portion 118 is pivotally connected to an axle pin 120 provided between the brackets 90 generally towards the end closer to the body portion 80 of the upper guard barrier 52. The connection portion 118 is connected to the pin 120 only at the opposite ends of the pin, leaving an opening (not shown) therebetween to expose the pin 120, so that the pin 120 is received in the forward notch 44 of the riving knife 22. The handle portion 116 of the flat spring 114 is connected to a curved tip 124 of the flat spring 114 which is configured to be removably latched to the rear notch 46 of the riving knife 22.

Preferably, the flat spring latch 114 is an integrated single piece of metal which is formed or crimped into the shape described above and as shown in FIGS. 10 and 11.

Accordingly, the metal material should have sufficient rigidity to hold its shape and also to firmly mount the blade guard assembly 24 onto the riving knife 22.

In operation, to mount the blade guard assembly 24 on the riving knife 22, the axle pin 120 is inserted into the forward notch 44 and the curved tip portion 124 is pressed onto the rear notch 46 until it is snapped on. In this position, the flat spring 114 is generally in a horizontal position with respect to the upper guard barrier 52 (best shown in FIGS. 10 and 11), and the forward and rear notches 44, 46 of the riving knife 22 are held firmly by the connection portion 118 and the tip portion 124 by the tension on the flat spring 114.

To remove the blade guard assembly 24 from the riving knife 22, the handle portion 116 is pressed upwardly to release the curved tip portion 124 from the rear notch 46. In this position, the riving knife 22 can be disengaged from the pin 120 and allowed to be removed from the mounting portion 54.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. A modular guard system for a power saw of the type which has a table top and a rotatable circular saw blade, the table top having an opening through which the saw blade can extend, said guard system comprising:

a riving knife for being mounted on the saw rearwardly of the blade, said riving knife having spaced first and second notches each having an opening facing away from each other; and a blade guard assembly that is releasably mounted on said riving knife for covering the saw blade, said blade guard assembly comprising:

a mounting portion receiving a top portion of said riving knife, the top portion having said first and second notches; and a release mechanism provided in said mounting portion, said release mechanism having a spring member positioned in engagement with said first notch and a latch member positioned in engagement with said second notch, said latch member being connected to said spring member;

wherein said latch member includes a handle, and an axle pin is secured to said mounting portion and positioned in engagement with said second notch in said top portion of said riving knife, said axle pin defining a pivot axis of said latch member such that said latch member is pivotally mounted on said axle pin so as to be pivotable with respect to the mounting portion and about the axle pin between a locked position and a released position, wherein said spring member includes a first end portion and a second end portion, said first end portion being attached to said latch member, said second end portion being positioned in engagement with said first notch, and wherein moving said handle of said latch member into said locked position exerts a force on said spring member to cooperatively hold said first and second notches between said spring member and said axle pin of said latch member to retain said riving knife in said mounting portion, and moving said handle into said released position removes said force exerted on said spring member to release said riving knife from said mounting portion.

2. A modular saw guard system as defined in claim 1, wherein said mounting portion includes a pair of spaced brackets that form a channel therebetween in which said top portion of said riving knife is received, and wherein said axle pin extends across said channel.

3. A modular saw guard system as defined in claim 2, wherein said mounting portion includes a pad extending from each of said brackets in said channel, said pads forming a slot in which said top portion of said riving knife is received.

4. A modular saw guard system as defined in claim 2, wherein said spring member is a wire loop, said first end portion of said wire loop being closed for engaging said first notch, said second end portion of said wire loop being connected to of said latch member opposite from the closed first end portion.

5. A modular saw guard system as defined in claim 4, wherein said first end portion of said wire loop is connected to said latch member through an aperture formed in said latch member.

6. A modular saw guard system as defined in claim 2, wherein said spring member is a flat spring with said second end portion having a hook portion that is positioned in engagement with said first notch, and said first end portion is located at an opposite end of said flat spring from said hook portion.

7. A modular saw guard system as defined in claim 6, wherein said first end portion of said flat spring is pivotally connected to a pin member provided on said latch member between said axle pin and said handle.

8. A modular saw guard system as defined in claim 2, wherein said latch member includes a first end portion and a second end portion, said first end portion of said latch member being pivotally connected to said axle pin, said second end portion of said latch member being located distally with respect to said axle pin, and wherein said spring member is pivotally connected to said latch member between said first end portion of said latch member and said second end portion of said latch member.

* * * * *